US005200667A

United States Patent [19]

Iwasaki et al.

[11] Patent Number: 5,200,667

[45] Date of Patent: Apr. 6, 1993

[54] COLOR CATHODE-RAY-TUBE WITH ELECTRICAL AND OPTICAL COATING FILM

[75] Inventors: Yasuo Iwasaki; Hiroshi Okuda, both of Nagaokakyo, Japan

[73] Assignee: Mitsubishi Denki Kabushiki Kaisha, Tokyo, Japan

[21] Appl. No.: 695,322

[22] Filed: May 3, 1991

[30] Foreign Application Priority Data

May 10, 1990 [JP] Japan ..... 2-122364
May 29, 1990 [JP] Japan ..... 2-138768

[51] Int. Cl.[5] ..... H01J 29/89

[52] U.S. Cl. ..... 313/478; 313/313; 313/479; 313/474

[58] Field of Search ..... 313/313, 467, 480, 478, 313/479, 473, 474

[56] References Cited

U.S. PATENT DOCUMENTS 4,728,856 3/1988 Iwasaki et al. ..... 313/467
4,873,120 10/1989 Itou et al. ..... 427/64
4,958,148 9/1990 Olson ..... 340/712
4,987,338 1/1991 Itou et al. ..... 313/478

FOREIGN PATENT DOCUMENTS

335680A2 10/1989 European Pat. Off. .
354465A2 2/1990 European Pat. Off. .
WO83026-82A1 8/1983 PCT Int'l Appl. .

*Primary Examiner*—Donald J. Yusko
*Assistant Examiner*—Michael Horabik

[57] ABSTRACT

A color cathode ray tube has a coating film formed over an outer surface of a face plate. The coating film prevents a charge-up phenomenon of the face plate and also has a function for improving a contrast performance of the color cathode ray tube. The coating film is composed of a polymer of silicon alkoxide, translucent conductive particles and plural types of dyes or pigments. The absorption peak of the main absorption band of the coating film is set in the range between the main spectrum wavelength of 570 nm of the green luminescence and the main spectrum wavelength of 610 nm of the red luminescence of the color cathode ray tube. The absorption peak of the sub absorption band of the coating film is in at least one of a first range between a wavelength of 380 nm and a wavelength of 420 nm and a second range between a wavelength of 470 nm and a wavelength of 510 nm.

7 Claims, 13 Drawing Sheets

COLOR CATHODE-RAY-TUBE WITH ELECTRICAL AND OPTICAL COATING FILM

BACKGROUND OF THE INVENTION

1. Field of the Invention

This invention relates to a color cathode-ray-tube, and more particularly to a color cathode-ray-tube having a coating film formed over the outer surface of a face plate.

2. Description of the Related Arts

In accordance with the increase of the size of a color cathode-ray-tube (hereinafter simply referred to as CRT) and the improvement of the brightness and focusing performances, a voltage to be applied to a phosphor screen disposed on the inner surface of the face plate, or an applied acceleration voltage of an electron beam, has recently been increased. For instance, a high voltage in the range of 25 to 27 kV has been applied to the phosphor screen of the color CRT having the size of 21-inches. However, in the color CRT having the size of 30-inches or more of recent models, a high voltage in the range no less than 30 to 34 kV is applied to the phosphor screen. With this result, the outer surface of the face plate of the color CRT is charged up when turning the power of a television set on and off. This charged-up outer surface of the face plate easily attracts small dust particles floating in the air, and is tainted by these dust particles. Such taintedness causes the brightness performance of the CRT to be impaired. Also, an electric discharge occurs when a viewer approaches the charged-up face plate, which brings discomfort to the viewer.

FIG. 9 is a graph showing variations in electric potential on the outer surface of the face plate of the CRT. The lateral axis of the graph depicts a time (seconds) counted from when the power is turned on and off, while the longitudinal axis of the graph depicts a surface potential (kV). A curved solid line L denotes variations in electric potential on the surface immediately after the power is turned on. Another curved solid line L1 denotes variations in electric potential on the surface right after the power is turned off. To prevent such a charge-up phenomenon occurring on the outer surface of the face plate of the CRT, there has been recently employed an antistatic type CRT for transferring the charge to earth (ground) by forming a flat and smooth transparent conductive film over the outer surface of the face plate.

FIG. 10 is a side elevation view showing the antistatic type CRT. This CRT 3 comprises a neck portion 6 which incorporates non-illustrated electron guns. The CRT 3 further comprises a deflection yoke 7, a funnel portion 13, a face plate 4 and a high voltage button 5. The deflection yoke 7 is connected to a deflecting power source of the deflection yoke 7 via a lead line 7*a*. Further, the electron guns are connected to a driving source via a lead line 6*a*. Furthermore, the high voltage button 5 is connected to a high power voltage source by way of a lead line 5*a*.

In the CRT 3, the electron beam emitted from the built-in electron guns of the neck portion 6 is deflected by an electromagnetic force exerted external to the CRT by means of the deflection yoke 7. Meanwhile, a high voltage is applied to the phosphor screen disposed on the inner surface of the face plate 4 via the high voltage button 5. This applied high voltage accelerates the electron beam, and the energy produced by the bombardment of this accelerated electron beam excites the phosphor screen to illuminate. As mentioned above, the external surface of the face plate 4 tends to charge up by the influence of the high voltage applied to the phosphor screen disposed on the inner surface of the face plate 4.

As one of the countermeasures to prevent such a charge-up phenomenon, a flat and smooth transparent conductive film 1 is formed over the outer surface of the face plate 4. The transparent conductive film 1 is connected to earth (ground), and the charge-up phenomenon on the outer surface of the face plate is prevented by constantly flowing the charge to ground.

In order to connect the transparent conductive film 1 formed over the outer surface of the face plate 4 and the earth, an implosion preventive metal band 8 wound around the side wall of the face plate 4, is connected to the transparent conductive film 1 by means of a conductive tape 12. This implosion preventive metal band 8 is connected to the earth 10A via an earth line 10 caught on a hook 9.

Broken lines M and M1 in FIG. 9 respectively designate variations in electric potential on the outer surface of the face plate 4 soon after the power of the antistatic type CRT 3 shown in FIG. 10 has been turned on and off. It is to be understood that the transparent conductive film 1 significantly reduces the charge on the outer surface of the face plate 4.

Since the transparent conductive film 1 on the outer surface of the face plate 4 involves a hardness and adhesiveness to some extent, the film is generally formed of a coating film made from silica compounds ($SiO_2$). According to one method of forming such a coating film 1 made from silica materials, after an alcohol solution of silicon alkoxide including a hydroxyl group and an alkoxyle group as a functional group has been uniformly and smoothly applied onto the outer surface of the face plate 4 by means of a spin coating method, the coating film is subjected to a relatively low temperature baking process of about 100 degrees or less.

Since the coating film 1 formed by the above method has a porous property and comprises a silanol group (≡Si—OH), it is possible to reduce an electrical resistivity on the surface of the face plate 4 by absorbing water from the air. However, if this coating film 1 is baked in a high temperature, the hydroxyl group, or —OH, included in the silanol group disappears and the water absorbed in the pores is lost, whereby the electrical resistivity of the coating film 1 is increased and a desirable electrical conductivity is hard to be obtained on the surface of the face plate 4. Therefore, the coating film 1 must be baked in a low temperature, and consequently the strength of the film becomes rather weak. Moreover, if the coating film 1 has been used for a long period under the aired condition, water retained in the porous coating film 1 evaporates, and the electrical resistivity increases with time. Once water has been vaporized away from the porous coating film 1, the coating film 1 cannot absorb water again.

To overcome such a drawback as set forth in the above description, attempts are now being made such as that which gives an electric conductivity to the coating film 1 by combining metallic atoms, e.g. a zirconium (Zr), with the alkoxide structure, but any substantial improvement has not yet been achieved.

As another method of improving the conductivity of the coating film 1, particles of a tin oxide ($SnO_2$) and an indium oxide ($In_2O_3$) are mixed and dispersed, as a conductive filler, into the alcohol solution of silicon alkoxide, and a paint added with a fairly small amount of phosphorus (P) or an antimony (Sb) is uniformly and smoothly applied over the outer surface of the face plate 4 by the spin coating method. Further the face plate coated with the paint is baked at a relatively high temperature of 100 to 200 degrees, for example. In accordance with this method, the strength of the coating film is improved, and it becomes possible to obtain a flat and smooth transparent conductive film 1, the electric resistivity of which is not varied with time under any circumstances.

In recent years, with a strong demand of a high quality color CRT, the improvement of the contrast and the color tone of the luminescence of the color CRT has been put into a practical use by coloring the transparent conductive film on the face plate. Namely, the mixture of a single dye or pigment made from organic or inorganic materials into a paint for producing the transparent conductive film over the face plate enables a colored paint to be obtained. By applying this colored paint onto the outer surface of the face plate and baking this painted face plate by means of the spin coating method, there is obtained a color CRT, shown in FIG. 11, having a coating film with a filter function for selectively absorbing a light within a predetermined range of wavelength, as well as the antistatic function. Specifically, although the color CRT of FIG. 11 appears similar to the color CRT 3 of FIG. 10, the coating film 2 formed over the face plate 4 of the color CRT 11 of FIG. 11 has the optical function and the electrical function as well.

FIG. 12 is a graph explaining the optical characteristic of the electrical and optical coating film 2 in the prior art. In the graph, a lateral axis denotes a wavelength of the light (nm), whereas the vertical axis denotes a relative luminous intensity (%) and a spectral transmittance (%). A curved line B shows a spectral distribution of the relative luminous intensity of blue luminescence on the phosphor screen of the color CRT, and the main spectrum wavelength is about 450 nm. Likewise, curved lines G and R respectively show the relative luminous intensity of the green luminescence and the red luminescence, and their main spectrum wavelengths are about 535 nm and 625 nm, respectively.

Curved lines II and III represent a spectral transmittance distribution of the face plate 4 itself used in the color CRT. The curved line II represents a transmittance distribution of a clear type face plate having a spectral transmittance of about 85% in a visible light region. In the meantime, the curved line III represents a distribution of a spectral transmittance of a tint type face plate having a transmittance of about 50% in the visible light region. It will be evident from the relationship among the spectral distributions of the curved lines B, G and R which represent the relative luminous intensity of the phosphor screen that the less the transmittance of the face plate, the worse the brightness performance of the color CRT is deteriorated. The tint type face plate, however, can effectively eliminate an external light incident on the phosphor screen of the color CRT. This type of the face plate is preferable for enhancing the contrast performance. Consequently, in accordance with the recent tendency in which a stress is laid on a picture quality of the color television receiver, the tint type face plate is widely adopted.

The curved line I represents one specific example of the spectral transmittance distribution of the electrical and optical coating film 2 in the prior art formed over the outer surface of the face plate 4 for enhancing the contrast performance. If an absorption peak point A of the coating film 2 comes close to one of the main spectrum wavelengths in between the main spectrum wavelength of 535 nm of the curved line G and the main spectrum wavelength of 625 nm of the curved line R, the brightness performance of the color CRT will be impaired. Therefore, the peak point A of the absorption band is usually set within the range of about 570 nm, through 610 nm taking into consideration a half band width of the absorption band. Since the light having a wavelength within this range is coincident with a relatively high area of a spectral luminous efficacy of human eyes, a light element of the external light (white light) having the wavelength within this range should preferably be absorbed to be eliminated in the light of the contrast performance. Consequently, it is extremely important to select a dye or a pigment made from organic or inorganic materials having the above-mentioned light absorbing characteristic, and the curved line I indicates a specific example of a pigment or a dye having the absorption peak point A at the wavelength of 572 nm.

Further, in the color CRT 11 having the electrical and optical coating film 2, since the light absorbing characteristic of a dye or a pigment consisting of organic or inorganic materials to be mixed in the coating film has a relatively broad band width, a tail region on the longer wavelength side of the main spectrum wavelength of the green luminescence and a sub peak portion on the shorter wavelength side of the main spectrum wavelength of the red luminescence are absorbed by this coating film. In short, it is possible to improve the color tone of the luminescence of the color CRT 11.

On this point, however, it is difficult to realize the aforesaid light absorbing spectrum of the coating film 2 within the specified range between 570 nm and 610 nm. This is because the pigment or dye consisting of a single organic or inorganic material which satisfies the above mentioned requirement is extremely rare to obtain. As another reason is that even if the light absorption peak itself of the dye or pigment is in the above specified range, other optical characteristics such as the skirt region of the absorption peak and the sub peak point, for example, may not match for the requirement to realize a desired the spectrum absorption in many cases. For these reasons, the appropriate dye or pigment is hard to select.

Furthermore there has been a drawback in the conventional color CRT having an antistatic type selective light absorbing film, since the absorption peak point of the main absorption band is in between 570 nm and 610 nm as the optical characteristic of the antistatic type selective light absorbing film, if the external light (white light) is reflected from the phosphor screen after having been incident on the phosphor screen of the color CRT with the antistatic selective light absorbing film, a large magnitude of lights having the wavelength within this range are particularly eliminated by the main absorption band. Thereby, the reflected light is colored. This drawback will be particularly described hereunder upon reference to FIG. 13. FIG. 13 also shows a spectrum locus (IV) of a blackbody radiation in a CIE standard chromaticity diagram. The points of the locus on a horse shoe shaped diagram shown in FIG. 13 depict the chromaticity point of each single color luminescence. The external light may slightly differ dependent on its type, but is chiefly a collective light flux composed of a plurality of single luminescences, like sun light. Most representative external light has a color temperature of 4500K or thereabout as designated by a point D. The phosphor screen of the conventional color CRT incorporating a face plate without the light absorbing film has achromatic color, or gray. With this phosphor screen, the light absorption is evenly effected across all of the wavelengths of the visible light. The outgoing light reflected from the phosphor screen looks like a natural light having a wavelength component similar to that of the incident light.

Meanwhile, in the case of the conventional color CRT with the selective light absorbing film having the absorption peak point A of the main absorption band at the wavelength of 572 nm as shown in FIG. 12-I, the light having the wavelength of 572 nm or thereabout of the external light (white light) incident on the phosphor screen is absorbed in this main absorption band to be removed. The chromaticity point of the reflected light shifts in the same direction as the direction to which the chromaticity point of the incident light is shifted away from the chromaticity point D of the original external light (white light). Shortly, a vector "a" arises along a line segment connecting between the chromaticity point D of the external light (white light) of 4500K and the chromaticity point of 572 nm of a single luminescence in a direction in which the vector moves away from the chromaticity point of 572 nm of the single luminescence in the chromaticity diagram, and the chromaticity point of the reflected light is shifted. This causes the reflected light to be colored.

In practice, in the case of the color CRT, it is considered that the audience views an original color of the phosphor screen itself when an image is being produced at a black level. Further if the light reflected from the phosphor screen is colored, a black color displayed on the screen looks unnatural. Thus the picture quality of the color television has been impaired to a large extent.

To overcome this drawback in the prior art, an object of the present invention is to provide a color cathode ray tube having an electrical and optical coating film whose absorption peak of an absorption band, superior in optical characteristic, is set within a specified range of wavelength.

Another object of the present invention is to provide a color cathode ray tube having a light selecting film by which a reflected light is not colored even though the absorption peak of the main absorption band is within the range and which is highly effective for improving the contrast performance, between 570 nm and 610 nm.

SUMMARY OF THE INVENTION

To this end, in accordance with one aspect of the present invention, there is provided a color cathode ray tube comprising: a face plate; and a coating film including a polymer of silicon alkoxide, translucent conductive particles, a plurality types of dyes or pigments and formed over the outer surface of a face plate, said coating film having an absorption peak of a main absorption band between the main spectrum wavelength of 570 nm of the green luminescence and the main spectrum wavelength of 610 nm of the red luminescence of a color cathode ray tube. The coating film further has a sub absorption band. Further absorption peak of the sub absorption band is in either a first range, on a side of wavelength shorter than the main spectrum wavelength of the blue luminescence, between 380 nm and 420 nm, or in a second range between the main spectrum wavelength of 470 nm of the blue luminescence and the main spectrum wavelength of 510 nm of the green luminescence.

The invention, however, both as to its organization and operation, together with further objects and advantages thereof, may best be appreciated by reference to the following detailed description taken in conjunction with the drawings.

BRIEF DESCRIPTION OF THE ACCOMPANYING DRAWINGS

DETAILED DESCRIPTION OF THE EMBODIMENTS

Figure 1:
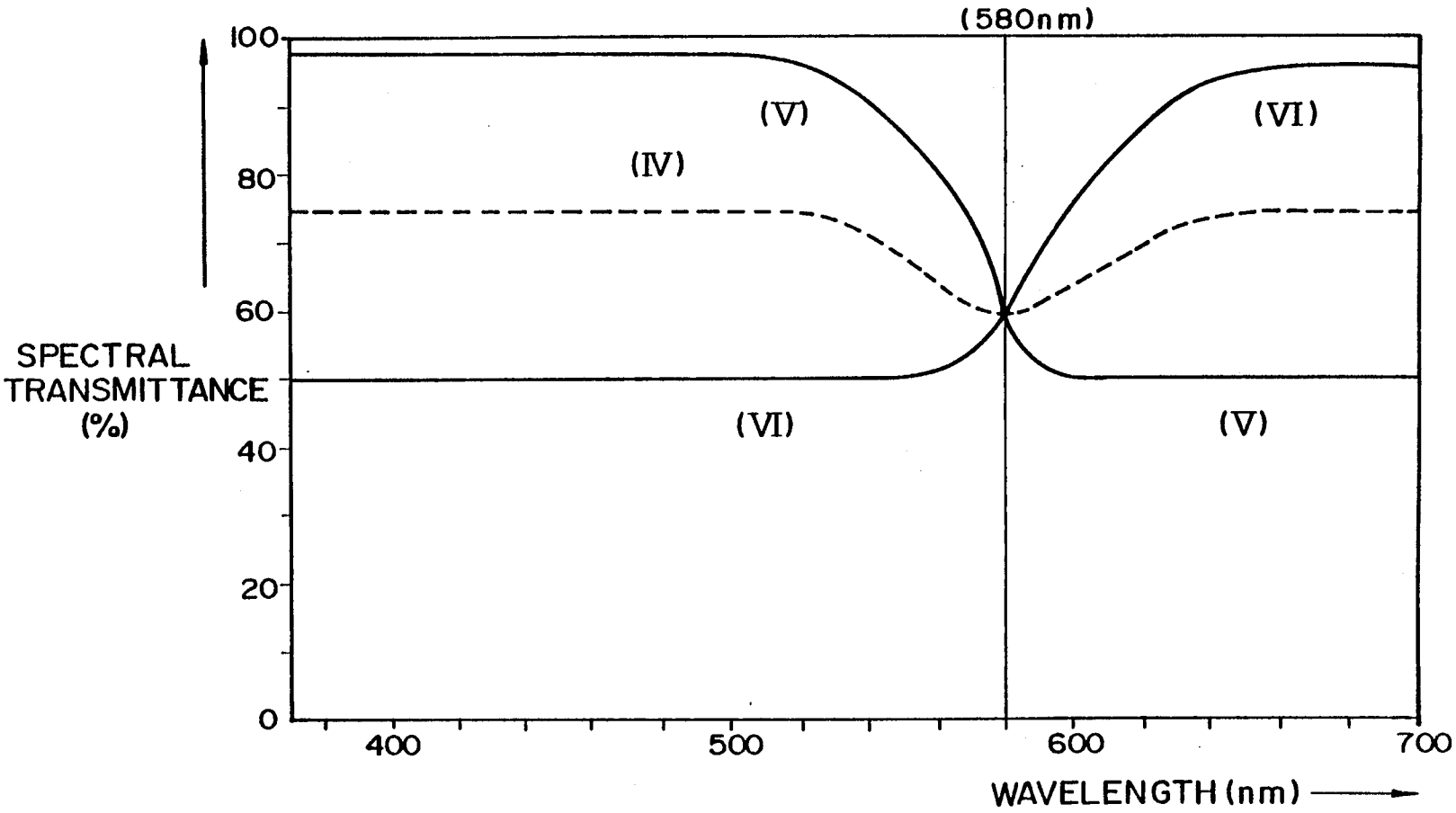
FIG. 1 is a graph showing an optical absorption characteristic of a coating film of a color cathode ray tube in accordance with a first embodiment of the present invention.

FIG. 1 of the accompanying drawings is a graph explaining a first embodiment of the present invention. In FIG. 1, a lateral axis represents a wavelength (nm) of a light, and a longitudinal axis represents a spectral transmittance (%). Namely, an electrical and optical coating film, formed over a face plate of a color CRT in accordance with a first embodiment of the present invention, contains two types of dyes and has an absorption peak at a wavelength of 580 nm. A curved solid line V denotes a transmittance of a dye of cyan which absorbs a light in the range of 500 nm or more. Meanwhile, another solid curved line VI denotes a transmittance of a dye of magenta which absorbs a light in the range of 640 nm or less. By mixing these two types of dyes together, an electrical and optical coating film, having an absorption peak at the wavelength of 580 nm as denoted by the curved line IV, can be obtained. In mixing the dyes, it is possible to shift the light absorption peak to a little extent by changing the mixing rate of the dye of cyan and the dye of magenta.

Figure 2:
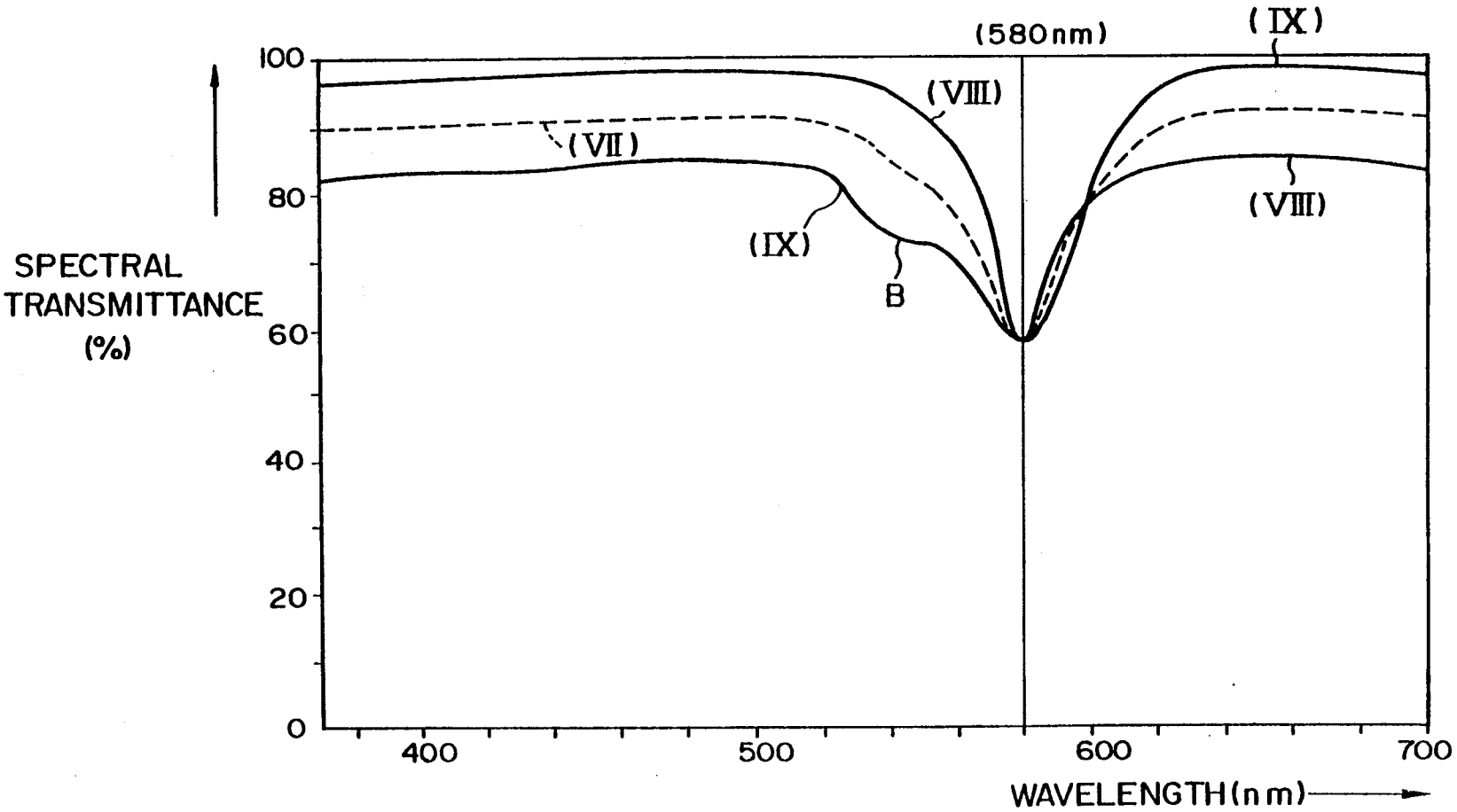
FIG. 2 is a graph showing a light absorbing characteristic of a coating film of a color cathode ray tube in accordance with a second embodiment of the present invention.

FIG. 2 is a graph explaining a second embodiment of the present invention. In this embodiment, the electrical and optical coating film contains two types of dyes, and has the absorption peak at the wavelength of 580 nm. A solid curved line VIII denotes a transmittance of a dye of cyan which solely exhibits a strong blue color. On the other hand, another solid curved line IX denotes a transmittance of a dye of magenta which solely exhibits a strong red color. At a skirt region on the shorter wavelength side of the absorption band, the red dye has a glitch B which represents an unnecessary absorption of the light. On this point, however, by mixing these two types of dyes VIII and IX together, an electrical and optical coating film having an absorption peak at the wavelength of 580 nm close to a red-purple color can be obtained as denoted by the broken curved line VII. During that time, the unnecessary light absorption occurred at the glitch B on the shorter wavelength side of the absorption band of the dye of magenta is reduced by the mixture of the two types of dyes.

The second embodiment being set forth has only referred to the color cathode ray tube having the electrical and optical coating film containing two types of dyes. Alternatively, the coating film may incorporate plural or in excess of two types of dyes. Moreover, the coating film may contain two types of pigments or more, instead of the dyes. Still further, the coating film may contain both the dyes and pigments. The more types of dyes and pigments that are contained in the coating film, the more accurately the optical characteristics of the coating film can be controlled.

Furthermore, the second embodiment refers to the electrical and optical coating film having one light absorption band. It will be manifest for those skilled in the art that the present invention may be applied to the case in which a coating film is expected to have a plurality of light absorption bands.

Figure 3:
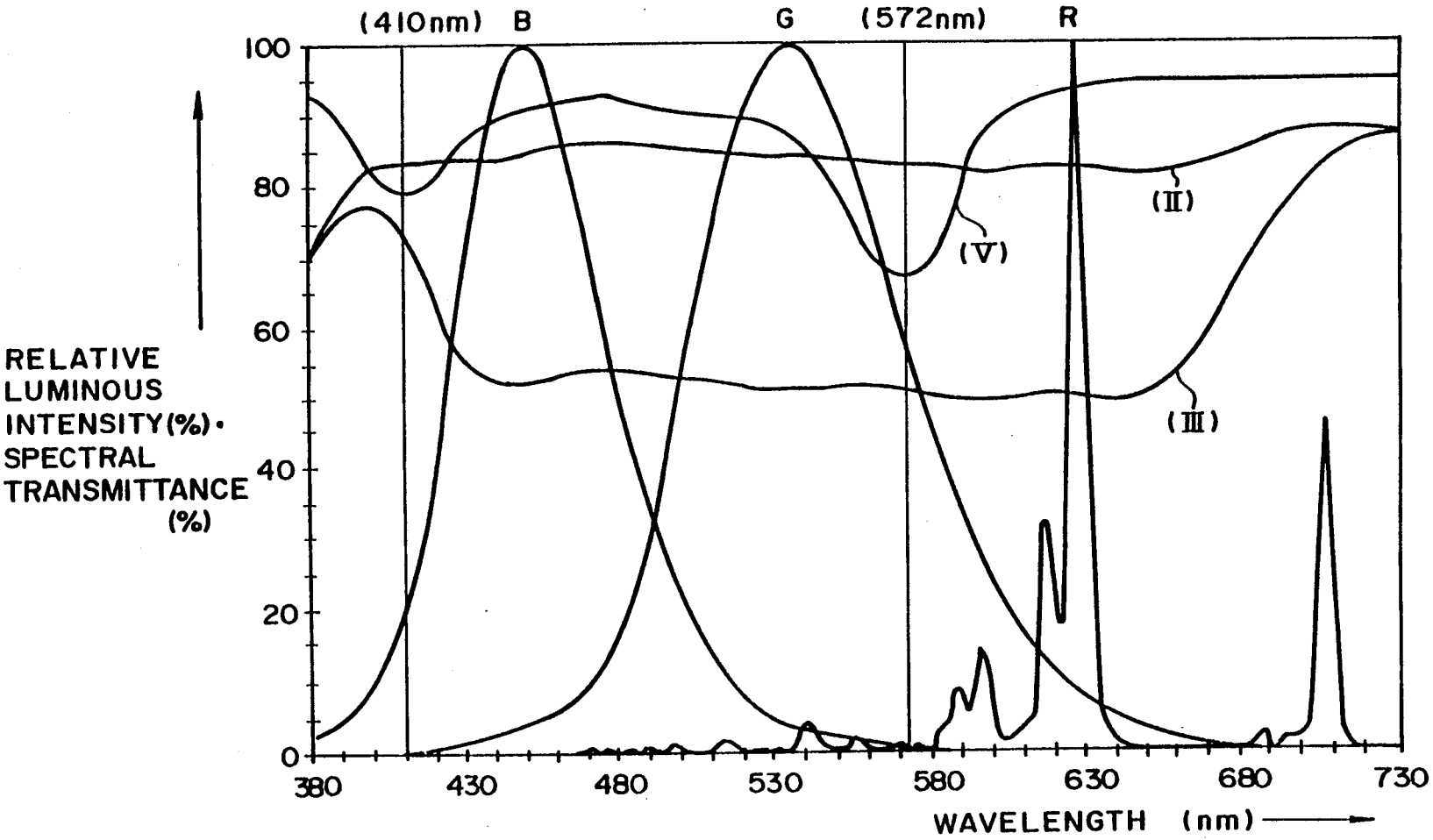
FIGS. 3 through 5 are characteristic diagrams showing an example of a distribution of a spectral transmittance of a selective light absorbing film used in the color cathode ray tube having a selective light absorbing film in accordance with a third through a fifth embodiment of the present invention.
Figure 6:
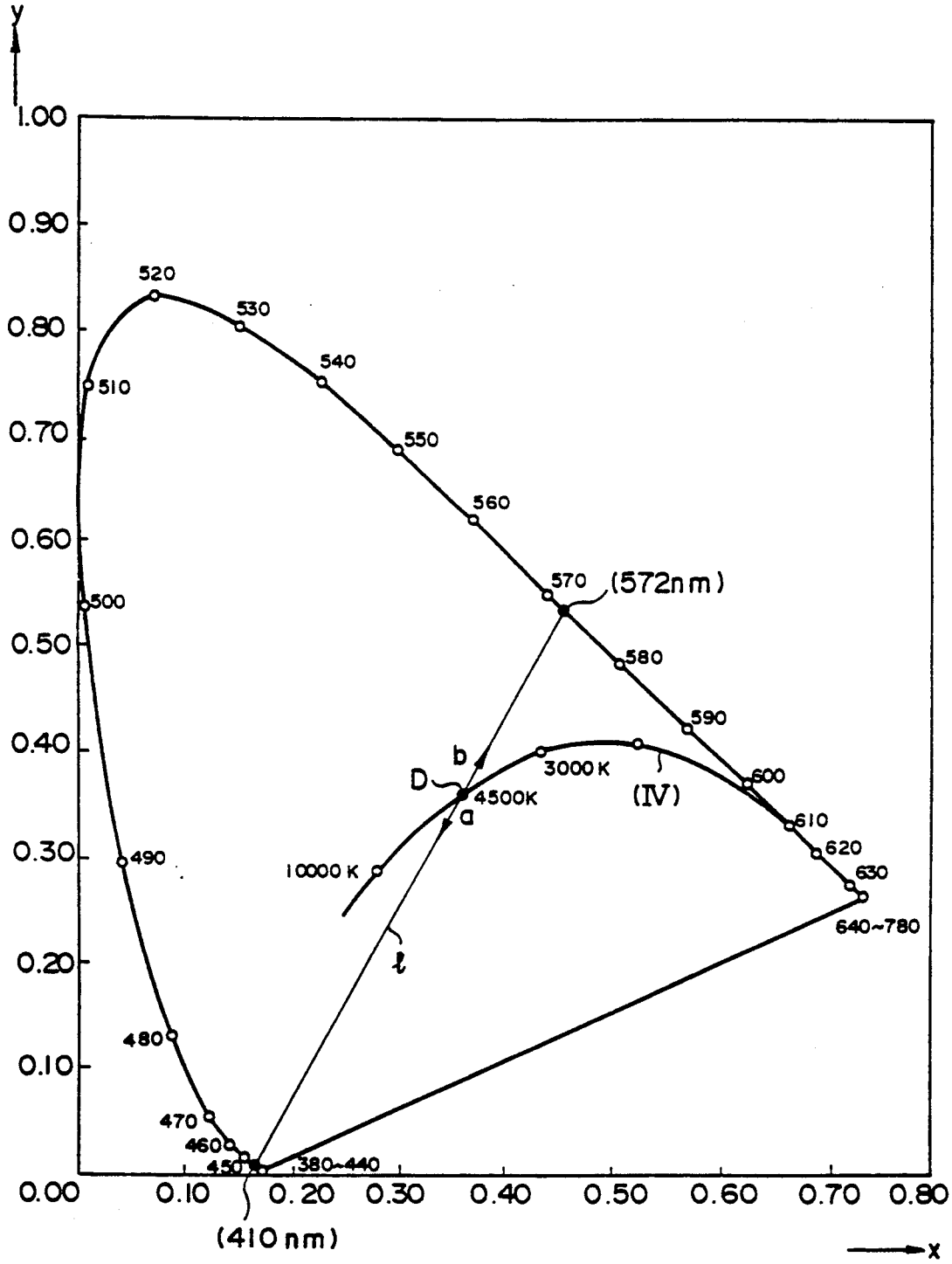
FIGS. 6 through 8 are CIE standard chromaticity diagrams explaining a coloring phenomenon of a reflected light and effects of the invention for reducing the coloring phenomenon in accordance with the third through fifth embodiments of the present invention.

A curved line V of FIG. 3 shows a distribution of a spectral transmittance of the selective light absorbing film of the color cathode ray tube having the selective light absorbing film in accordance with a third embodiment of the present invention. This light absorbing film has the conventional main absorption band having the absorption peak at the wavelength of 572 nm and the absorption peak of a sub absorption band at the wavelength of 410 nm, or a shorter wavelength side of the light spectrum wavelength (approximately 550 nm) of the blue luminescence as well. A coloring phenomenon of the reflected light and effects of the second embodiment for reducing such a coloring phenomenon are described upon reference to the CIE standard chromaticity diagram of FIG. 6. When a chromaticity point of the external light (white light) having the color temperature of 4500K is depicted by D, a light in the vicinity of the wavelength of 572 nm among the external light, incident on the phosphor screen, is absorbed and eliminated by the main absorption band. With this result, the chromaticity point of the reflected light moves away from the chromaticity point D of the original external light (white light), which has been incident on the phosphor screen. In detail, on the chromaticity chart, a vector "a" arises on the line segment "l" connecting between the chromaticity point D of the external light (white light) of 4500K and the chromaticity point of a single luminescence of 572 nm, in a direction in which the vector moves away from the chromaticity point of the single luminescence of 572 nm, and whereby the reflected light is colored.

A node at which the line segment "l" crosses the horse shoe line of the chromaticity diagram again coincides with the wavelength of 410 nm. Therefore, if the absorption peak of the sub absorption band is at the wavelength of 410 nm as shown in FIG. 3, a vector "b" which countervails the vector "a" caused by the absorption peak at 572 nm of the main absorption band arises to correct the deviation of the chromaticity point of the reflected light. It is necessary to take balance of the amount of the spectral absorption at the absorption peak of the main absorption band and the absorption peak of the sub absorption band in order to correct the deviation of the chromaticity points between the incident light and the reflected light completely. In this case, the absorption peak of the sub absorption band is positioned on the shorter wavelength side of the light spectrum wavelength (450 nm) of the blue luminescence. However, if the absorption peak of the sub absorption band is located at the position close to the main spectrum wavelength (450 nm), the brightness performance of the phosphor screen of the color CRT will be impaired. Accordingly, the absorption peak of the sub absorption band is set in the range between the wavelength of 380 nm and the wavelength of 420 nm taking into consideration the half band width of the absorption band.

Figure 4:
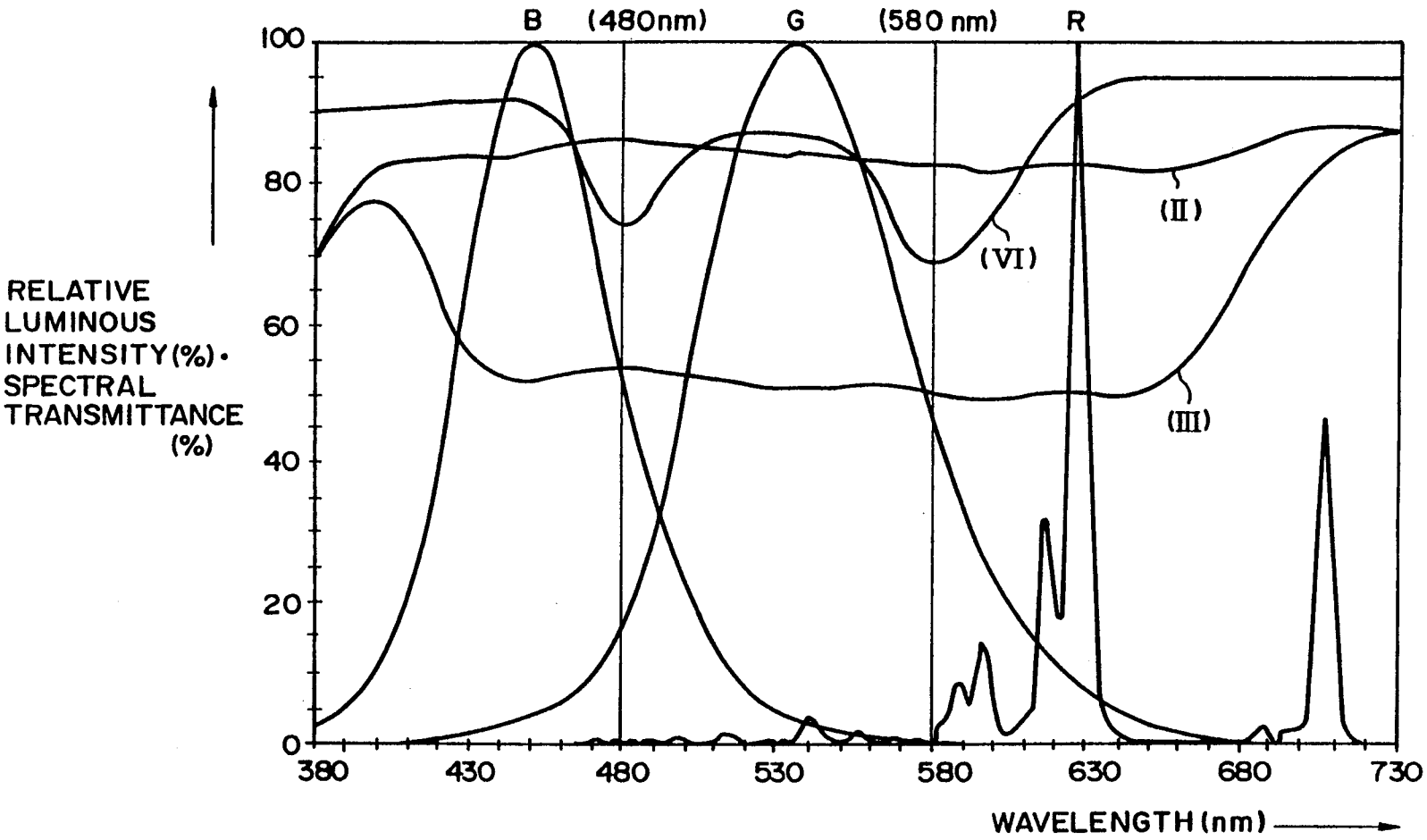
Figure 7:
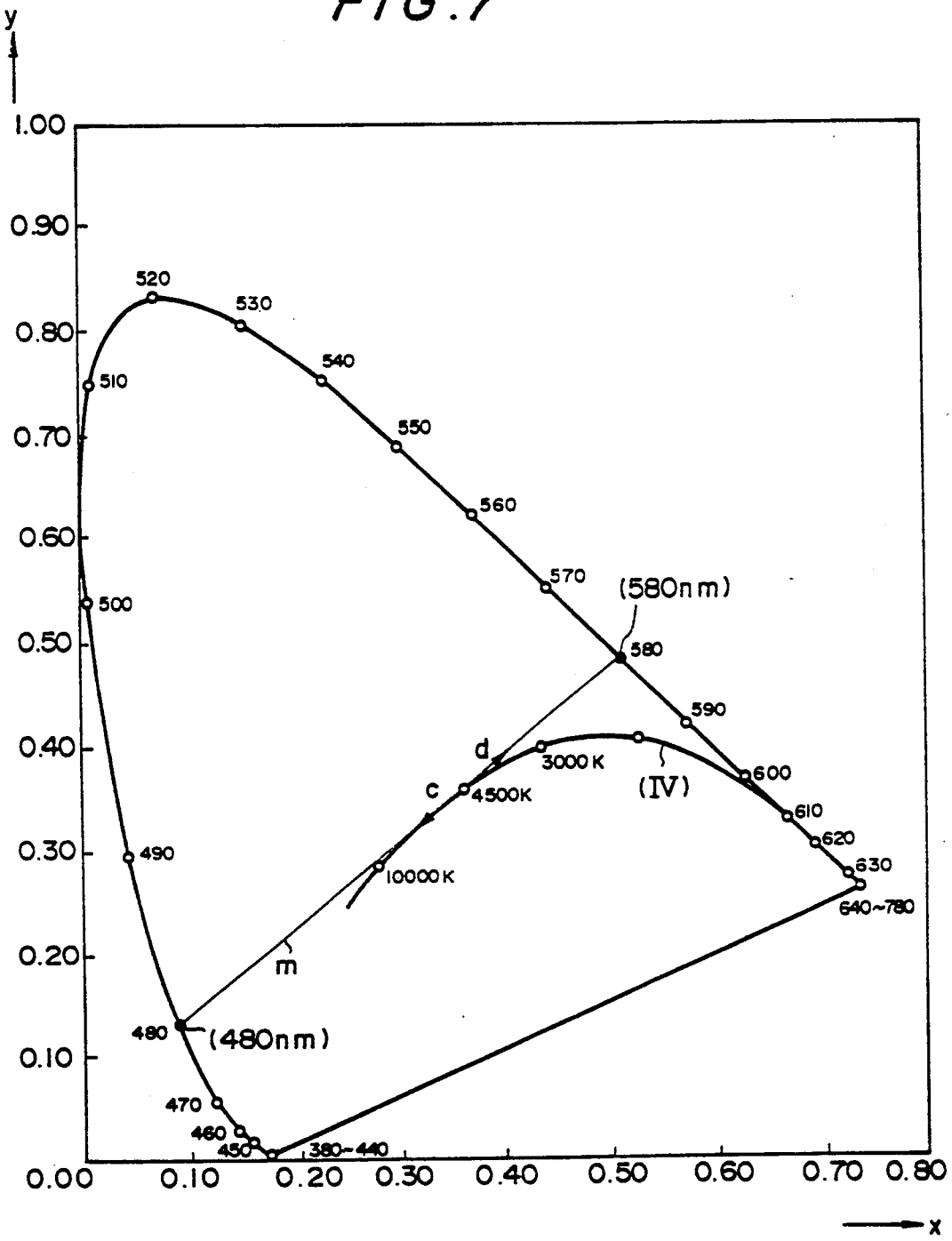
Figure 8:
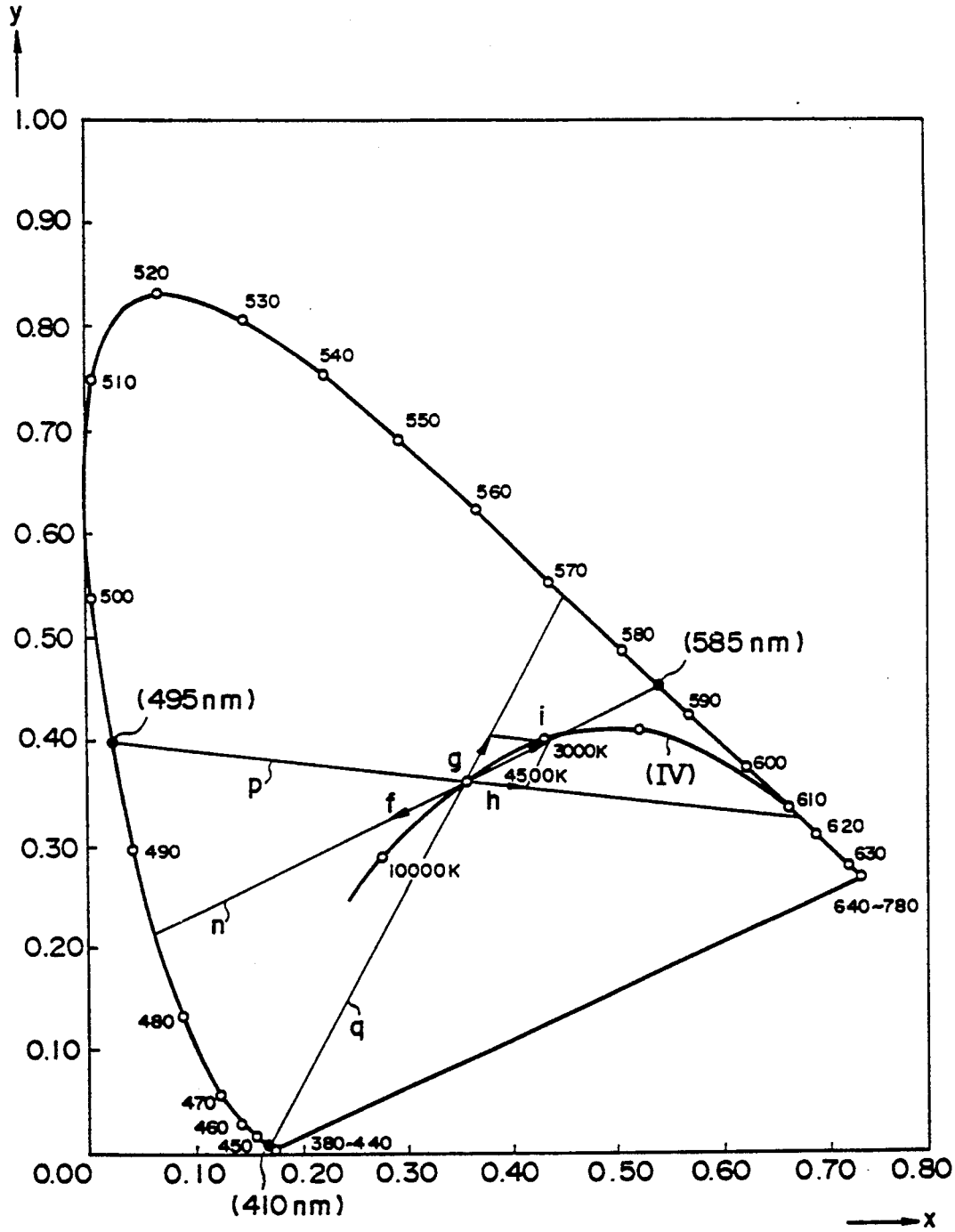
Figure 9:
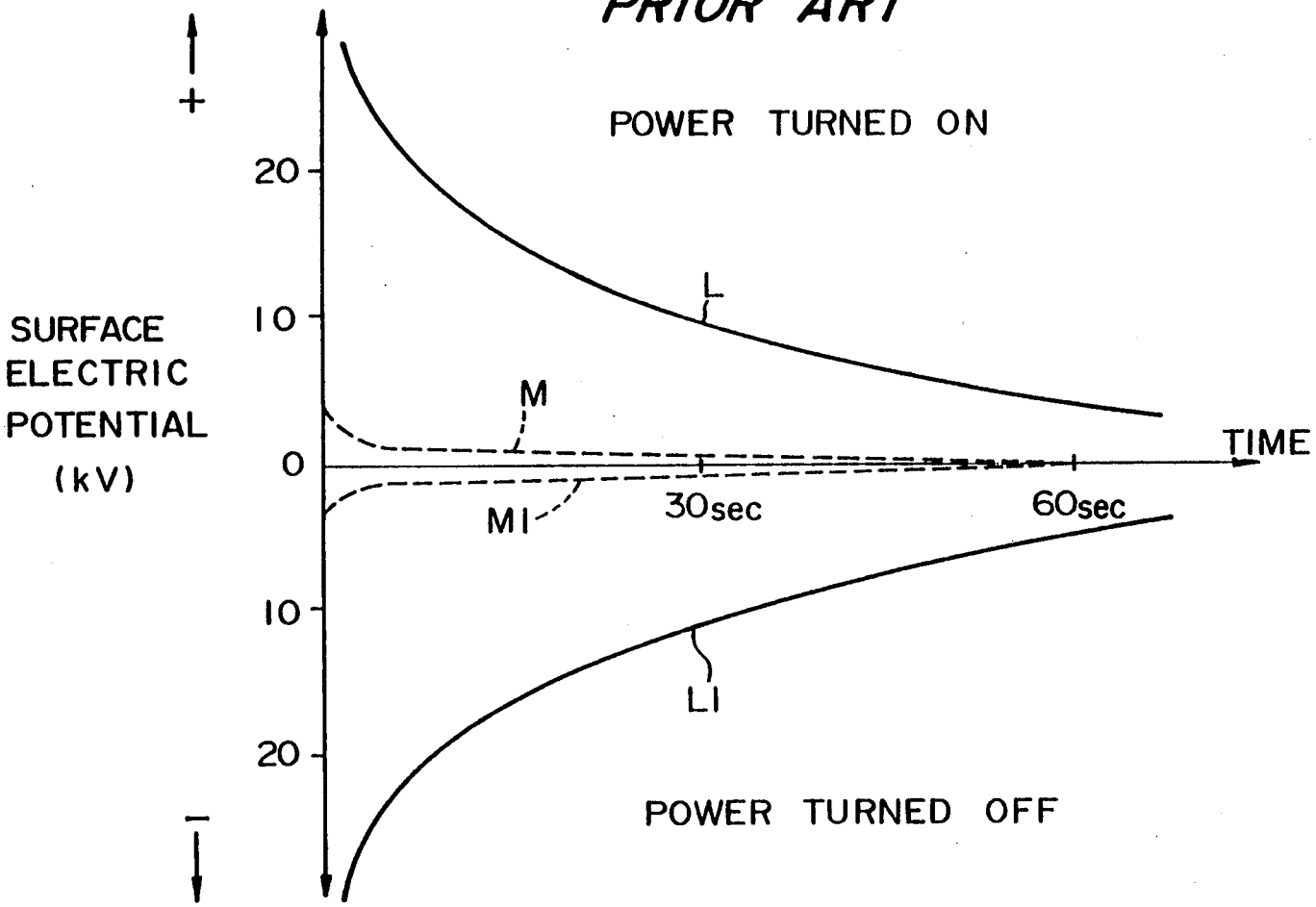
FIG. 9 PRIOR ART
FIG. 9 is a graph explaining a charge-up phenomenon on an outer surface of a face plate of the color cathode ray tube.
Figure 10:
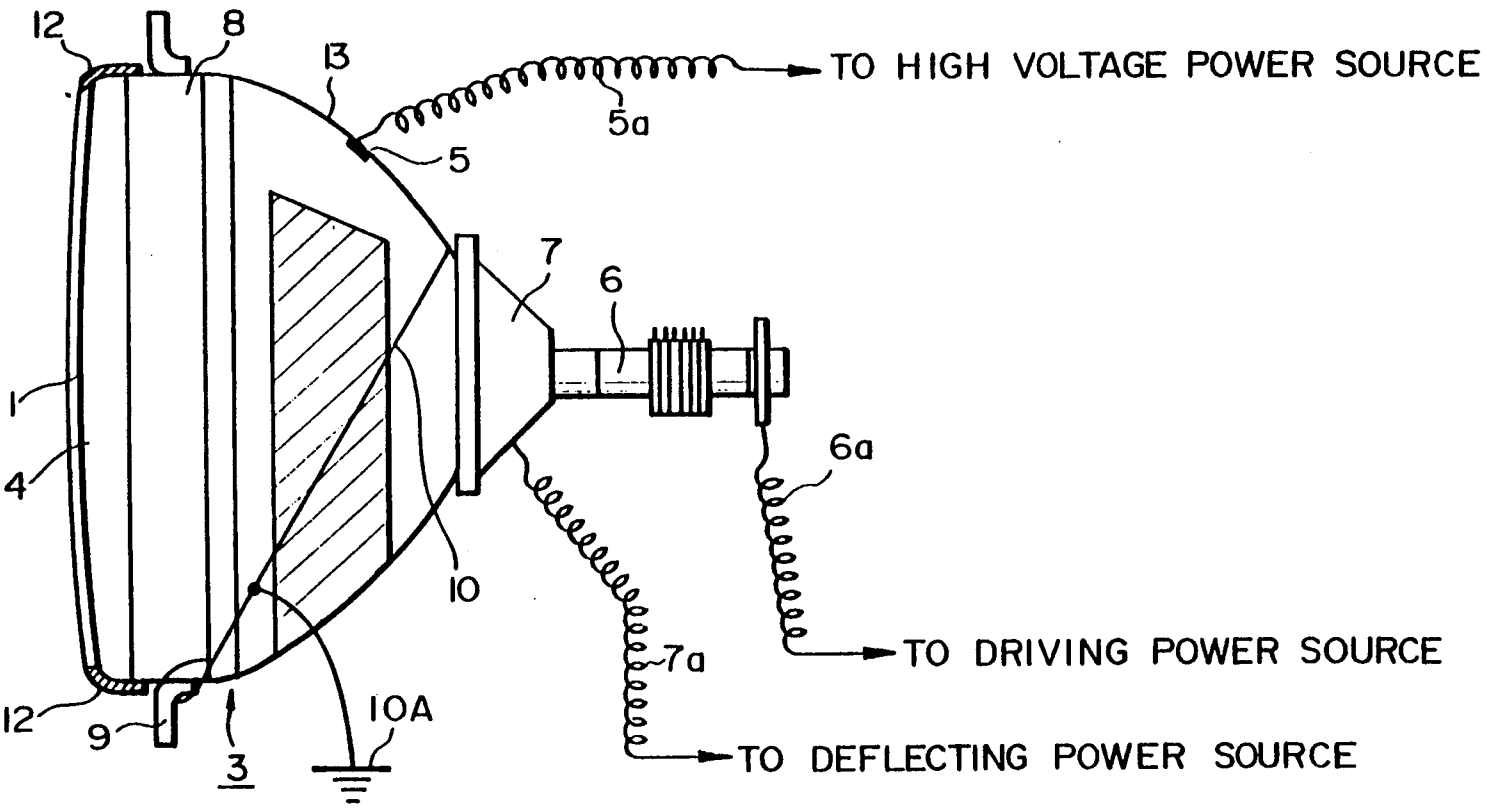
FIG. 10 PRIOR ART
FIG. 10 is a side elevation view showing an antistatic type color cathode ray tube.
Figure 11:
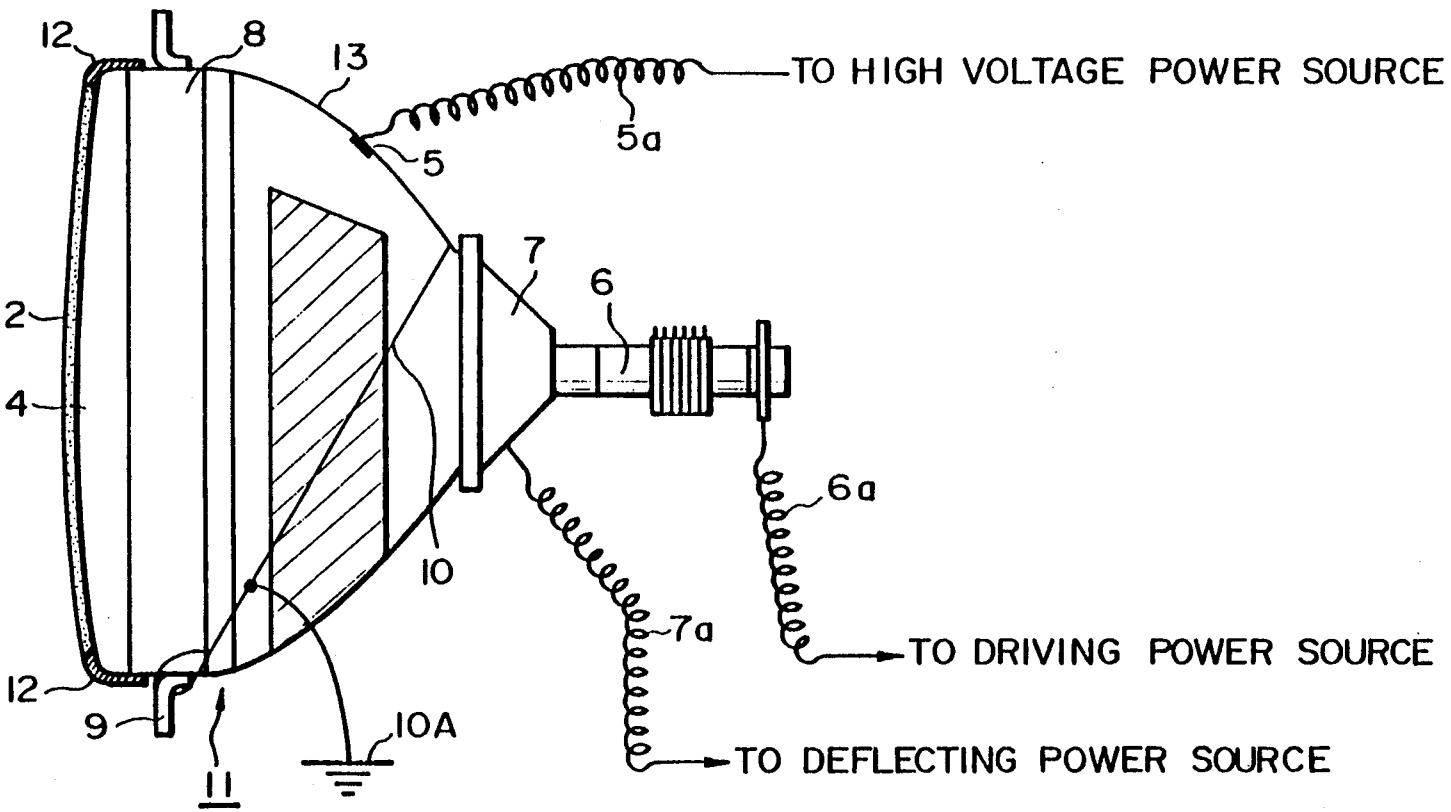
FIG. 11 PRIOR ART
FIG. 11 is a side elevation view showing a color cathode ray tube having an electrical and optical coating film.
Figure 12:
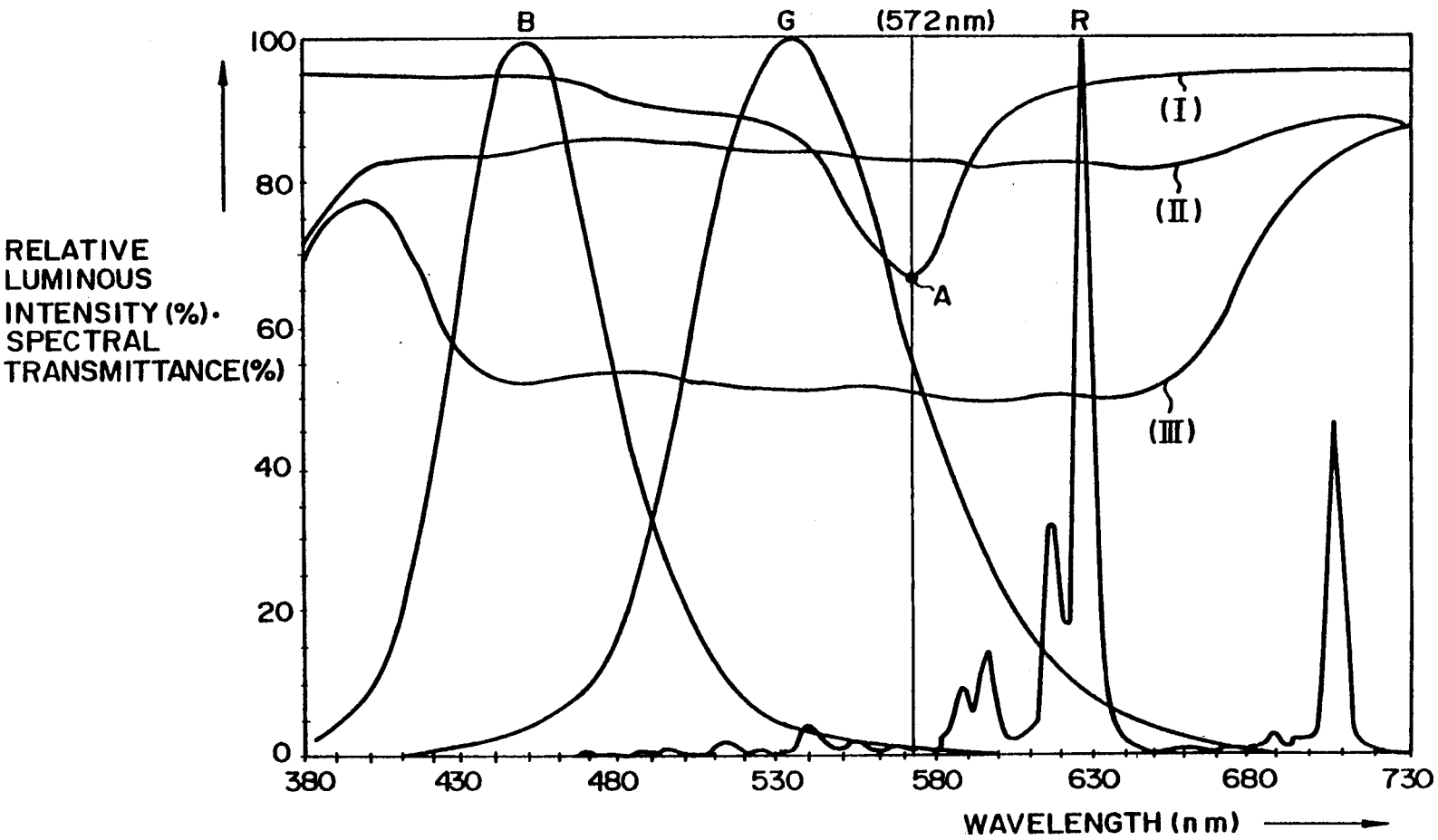
FIG. 12 PRIOR ART
FIG. 12 is a graph showing a relationship between the absorbing characteristic of the electrical and optical coating film in a prior art and an optical characteristic of a phosphor screen.
Figure 13:
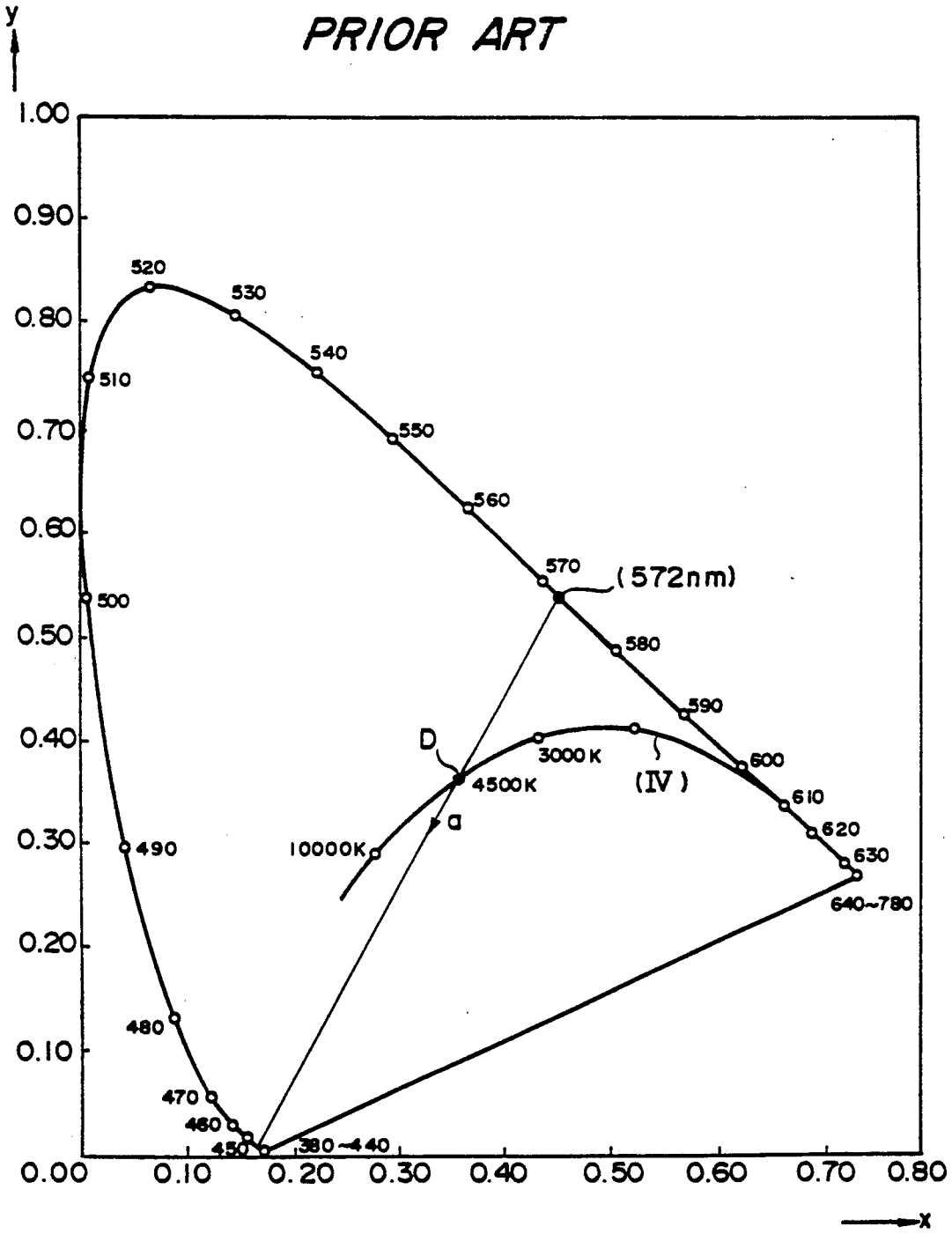
FIG. 13 PRIOR ART
FIG. 13 is a CIE standard chromaticity diagram explaining a reflected light of a conventional color cathode ray tube having an antistatic type selective light absorbing film.

Likewise, FIG. 4 shows a specific example of a distribution of a spectral transmittance of the selective light absorbing film of the color CRT having the selective light absorbing film in accordance with a fourth embodiment of the present invention. In addition to the main absorption band having the absorption peak at the wavelength of 580 nm, the sub absorption band of the selective optical absorption film has an absorption peak at the wavelength of 480 nm in between the light spectrum wavelength of the blue luminescence and the light spectrum wavelength of the green luminescence. The coloring phenomenon of the reflected light and effects of the fourth embodiment for reducing such coloring phenomenon are illustrated in the CIE standard chromaticity diagram of FIG. 7. According to FIG. 4, a vector C caused by the absorption peak at 580 nm of the main absorption band countervails a vector d caused by the absorption peak at 480 nm of the sub absorption band each other. Further the deviation of the chromaticity point of the reflected light is corrected. Since the brightness performance of the phosphor screen of the color cathode ray tube will be impaired if the absorption peak of the sub absorption band is set in the region close to the range between the light spectrum wavelength of 450 nm of the blue luminescence and the light spectrum wavelength of 535 nm of the green luminescence, the absorption peak of the sub absorption band is set in between the wavelength of 470 nm and the wavelength of 510 nm, taking into consideration the half band width of this absorption band.

Figure 5:
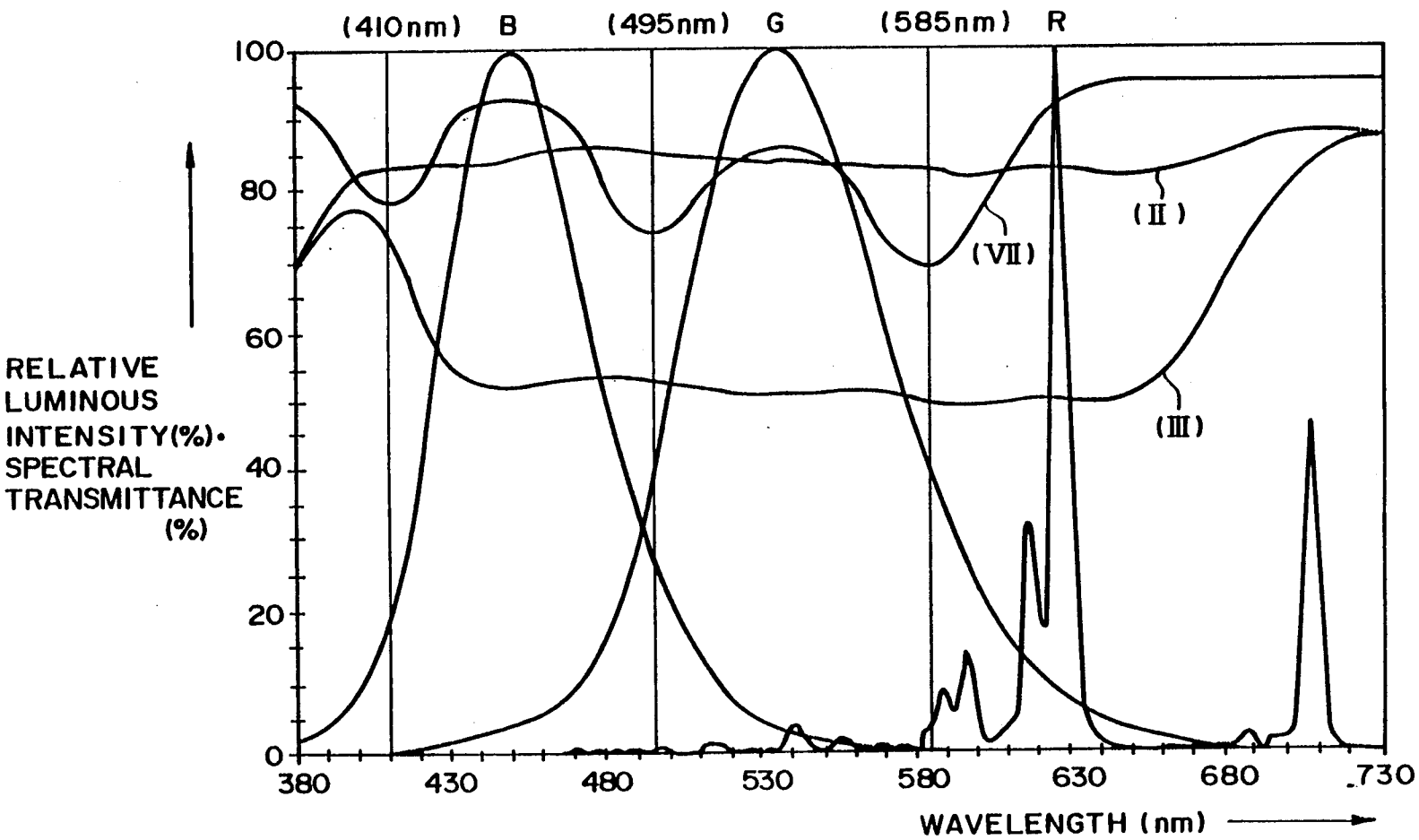

In the same manner, FIG. 5 shows a specific example VII of a distribution of the spectral transmittance of the selective light absorbing film of a color CRT having a selective light absorbing film in accordance with a fifth embodiment of the present invention. In this embodiment, the selective light absorbing film has a sub absorption band having two peaks at 495 nm between the main spectrum wavelength of the blue luminescence and the main spectrum wavelength of the green luminescence and at 410 nm, on the shorter wavelength side of the main spectrum wavelength of the blue luminescence, as well as the main absorption band having the absorption peak at the wavelength of 585 nm. A coloring phenomenon of the reflected light and effects of the fifth embodiment for reducing the coloring phenomenon will be shown in the CIE standard chromatic diagram. In this embodiment, a vector "f" caused by the absorption peak of the main absorption band of 585 nm, vectors "g" and "h" caused by the absorption peaks of the sub absorption bands of 410 nm and 495 nm and a composite vector "i" of the vectors "g" and "h" cancel each other. Further, they thereby modify the deviation of the chromaticity point of the reflected light.

The fifth embodiment has referred to the case in which the light selecting characteristic is given to the transparent conductive film used in the conventional antistatic type CRT by mixing the dyes or pigments consisting of organic or inorganic materials into the conductive film. As a matter of course, the present invention should not be restricted to these specific embodiments, but may be applied to a transparent film having no antistatic preventive function, for example.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description. Further all changes which come within the meaning and range of equivalency of the claims are therefore intended to be embraced therein.

What is claimed is:

1. A color cathode ray tube, comprising:
a face plate; and
a coating film including a polymer of silicon alkoxide, translucent and conductive particles, and a plurality of types of dyes or pigments and formed over an outer surface of said face plate;
said coating film having a main absorption band with an absorption peak in a range between a wavelength of 570 nm and a wavelength of 610 nm which is between a main spectrum of green luminescence and a main spectrum of red luminescence;
said coating film further having a sub-absorption band with a maximum sub-absorption peak in a range between a wavelength of 380 nm and a wavelength of 420 nm.

2. The color cathode ray tube according to claim 1, wherein said sub-absorption band has another sub-absorption peak within a range from a wavelength of 470 nm to a wavelength of 510 nm.

3. The color cathode ray tube as claimed in claim 2 wherein said another sub-absorption peak is also a maximum sub-absorption peak.

4. A color cathode ray tube, comprising:
a face plate; and
a coating film including a polymer of silicon alkoxide, translucent and conductive particles and a plurality of types of dyes or pigments and formed over an outer surface of said face plate;
said coating film having a main absorption band with an absorption peak in a range from a wavelength of 570 nm to a wavelength of 610 nm;
said coating film further having a sub-absorption band with a maximum sub-absorption peak in a range from a wavelength of 470 nm to a wavelength of 510 nm.

5. The color cathode ray tube as claimed in claim 4 wherein said sub-absorption band has another sub-absorption peak in a range from a wavelength of 380 nm to a wavelength of 420 nm.

6. A color cathode ray tube comprising:
a face plate; and
a coating film formed on an outer surface of said face plate;
said coating film having a main absorption band such that an absorption peak of said main absorption band is between a main spectrum of red luminescence and a main spectrum of green luminescence;
said coating film further having a sub-absorption band with a maximum sub-absorption peak;
said maximum sub-absorption peak being either between a main spectrum of green luminescence and a main spectrum of blue luminescence or at a wavelength which is shorter than the main spectrum of blue luminescence.

7. A color cathode ray tube comprising:
a face plate; and
a coating film formed on an outer surface of said face plate;
said coating film having a main absorption band such that an absorption peak of said main absorption band is between a main spectrum of red luminescence and a main spectrum of green luminescence;
said coating film further having a sub-absorption band with two maximum sub-absorption peaks;
said two maximum sub-absorption peaks being a first maximum sub-absorption peak positioned between the main spectrum of green luminescence and the main spectrum of blue luminescence and a second maximum sub-absorption peak positioned at a wavelength which is shorter than the main spectrum of blue luminescence.

* * * * *